US006246032B1

(12) United States Patent
Quinn et al.

(10) Patent No.: US 6,246,032 B1
(45) Date of Patent: Jun. 12, 2001

(54) HOT BEVERAGE FLAVOR PROTECTOR

(76) Inventors: Thomas A. Quinn; Kerry A. Oswald, both of 5 Liberty La., Lincoln University, PA (US) 19352; Robert Scott Seifert, 13125 Lauren La., Midlothian, VA (US) 23113

( * ) Notice: Subject to any disclaimer, the term of this patent is extended or adjusted under 35 U.S.C. 154(b) by 0 days.

(21) Appl. No.: 09/540,468

(22) Filed: Mar. 31, 2000

Related U.S. Application Data

(63) Continuation-in-part of application No. 09/291,783, filed on Apr. 14, 1990, now abandoned.

(51) Int. Cl.[7] ..... F27D 11/00

(52) U.S. Cl. ..... 219/433; 219/529; 219/549; 219/430

(58) Field of Search ..... 219/433, 432, 219/430, 439, 429, 434, 438, 443.1, 528, 529, 530, 533, 540, 548, 549; 338/208

(56) References Cited

U.S. PATENT DOCUMENTS

| | | | |
|---|---|---|---|
| 3,485,706 | 12/1969 | Evans | 161/72 |
| 3,558,858 | 1/1971 | Luger, Jr. | 219/528 |
| 3,885,129 | 5/1975 | Fabricius | 219/433 |
| 4,065,660 | 12/1977 | Berard | 219/433 |
| 4,160,152 | 7/1979 | Wightman et al. | 219/430 |
| 4,715,269 | 12/1987 | Stoner | 219/432 |
| 4,798,937 | 1/1989 | Guerrero | 219/433 |
| 4,896,022 | 1/1990 | Schroeder et al. | 219/433 |
| 4,983,798 | 1/1991 | Eckler et al. | 219/439 |
| 4,994,649 | 2/1991 | Roland, Sr. et al. | 219/433 |
| 5,073,699 | 12/1991 | Box | 219/433 |
| 5,183,995 | 2/1993 | Addison et al. | 219/433 |
| 5,196,677 | 3/1993 | Stasyshyn | 219/433 |
| 5,484,983 | 1/1996 | Roell | 219/529 |

FOREIGN PATENT DOCUMENTS

| | | | |
|---|---|---|---|
| 2 225 969 | 6/1990 | (GB) | B24D/13/00 |
| 39 38 578 | 6/1990 | (DE) | B24D/13/08 |

*Primary Examiner*—Teresa Walberg
*Assistant Examiner*—Fadi H. Dahbour

(57) ABSTRACT

A fabric disk to protect the flavor coffee or tea from excess heating comprising heat resistant fibers.

29 Claims, 4 Drawing Sheets

HOT BEVERAGE FLAVOR PROTECTOR

This is a continuation-in-part of application Ser. No. 09/291,783, filed Apr. 14, 1990, now abandoned.

BACKGROUND OF THE INVENTION

The enjoyment of a hot beverage such as coffee or tea is dependent on the flavor experienced by the consumer. The flavor sensation for beverages that are served hot is a combination of the actual taste of the beverage and the temperature of the beverage. Although automatic devices for making coffee or hot tea are designed to hold the beverage at a temperature (holding temperature) at which the consumer will experience a desirable flavor sensation, the flavor of the beverage deteriorates if the beverage is maintained at the holding temperature for a period of time, often not more than one hour. The longer the coffee or tea is kept at the holding temperature, the greater the risk that the flavor may become bitter, burned or scorched. One solution to this problem practiced by food service industry is to periodically brew a fresh batch of the beverage. This solution to the flavor problem costs the food service industry time and money since a worker must throw out any beverage not yet consumed and must take the time and use materials to set up and make a "new pot".

Several patents address the problem of preserving the flavor of coffee. U.S. Pat. No. 4,798,937 teaches a plastic covered hot plate having concentric grooves about the center of the hot plate. These groves form open areas through which air can circulate to moderate the temperature of the beverage.

U.S. Pat. No. 5,196,677 teaches a coffee maker having a metal spacer which separates the coffee pot from the hot plate in combination with heat sensing alarms that provides a warning if the level of fluid in the coffee pot is below a set level. The metal spacer has a central opening which provides an air space between the coffee pot and the hot plate to lower the temperature of the coffee.

U.S. Pat. No. 4,994,694 teaches a circular spacer having openings that attenuate the heat that is applied to the coffee pot by the hot plate. This attenuator ring may be attached to the pot or to the hot plate. The attenuator ring works to create an air space between the hot plate and the coffee pot to lower the temperature of the coffee.

The inventors of the present invention wanted to provide a means to keep the flavor of coffee or tea fresh while at the same time maintaining the temperature of the beverage at a high holding temperature which results in the preferred flavor experience for a vast majority of coffee drinkers.

SUMMARY OF THE INVENTION

The present invention provides a fabric disk for protecting the flavor of coffee or tea wherein the disk is placed between a container in which the beverage is stored and a hot plate which supports the container and also keeps the beverage hot, the fabric disk comprising heat resistant fibers wherein the heat resistant fiber contains at least 5% by weight p-aramid fibers. It is preferred that the disk has a thickness of less than about 12 mils and a density of less than about 2 oz/yd$^2$ (34 g/m$^2$). The disk may be a woven or non-woven fabric. The woven disk may be formed from heat resistant fibers 60% by weight m-aramid fibers and 40% by weight p-aramid fibers. For a woven disk it is preferred that the m-aramid and p-aramid fibers form yarns and the yarns are woven in a rip-stop weave. It is preferred that the edge of the fabric disk is stabilized from raveling by the addition of a binder or by fusing.

The present invention also provides a brewing apparatus for brewing coffee or tea, the apparatus having a hot plate and a movable beverage container the bottom of which is in contact with the hot plate, a fabric disk comprising heat resistant fibers wherein the disk has a thickness of less than about 12 mils and a density of less than about 2 oz/yd$^2$ (34 g/m$^2$) and wherein the disk is sized to cover the hot plate and is positioned between the container bottom and the hot plate.

The disk formed from a woven or non-woven fabric may be treated with a water repellent or stain repellent coating. In a woven fabric disk, it is preferred that the disk is treated with an adhesive that is stable at the holding temperature and temporary in nature.

The present invention also provides a non-woven fabric disk for protecting the flavor of coffee or tea wherein the disk is placed between a container in which the beverage is stored and a hot plate which supports the container and also keeps the beverage hot, the fabric disk comprising heat resistant fibers wherein the disk has a thickness of less than about 12 mils and a density of less than about 2 oz/yd$^2$ (34 g/m$^2$) The disk of may be formed from spun laced fabrics, spun bonded fabrics, melt blown fabrics or woven fabrics. The preferred fabric for the present invention is a spun laced fabric. Preferably these non-woven fabrics are patterned, resulting in uniform thick and thin regions throughout the fabric.

The heat resistant fibers of these fabrics are preferred to be m-aramid or a mixture of m-aramid and p-aramid fibers. It is also preferred that the disk have at least one surface treated to increase friction between the disk and the hot plate. The most preferred treatment is a thin, discontinuous coating of silicon material. The preferred method by which thin, discontinuous coating is applied to the disk is by a printing process.

The present invention also provides method of brewing coffee or tea wherein heated water is passed through grounds of coffee or leaves of tea into a container supported on a hot surface designed to maintain the coffee or tea at a holding temperature above room temperature, method comprising placing between the container and the hot surface a fabric disk comprising heat resistant fibers wherein the disk has a thickness of less than about 12 mils and a density of less than about 2 oz/yd$^2$ (34 g/m$^2$). In this embodiment of the invention it is preferred that the heat resistant fibers are m-aramid or a mixture of m-aramid and p-aramid fibers. It is also preferred that at least one surface of the disk is treated to increase friction between the disk and the hot plate. It is most preferred that the treatment is a thin, discontinuous coating of silicon material. Such coating is preferred to be applied by a printing process.

The disk of the present invention and in any of its embodiments is preferred to have a generally round symmetrical shape such as a circle or a polygon.

DETAILED DESCRIPTION

Figure 1:
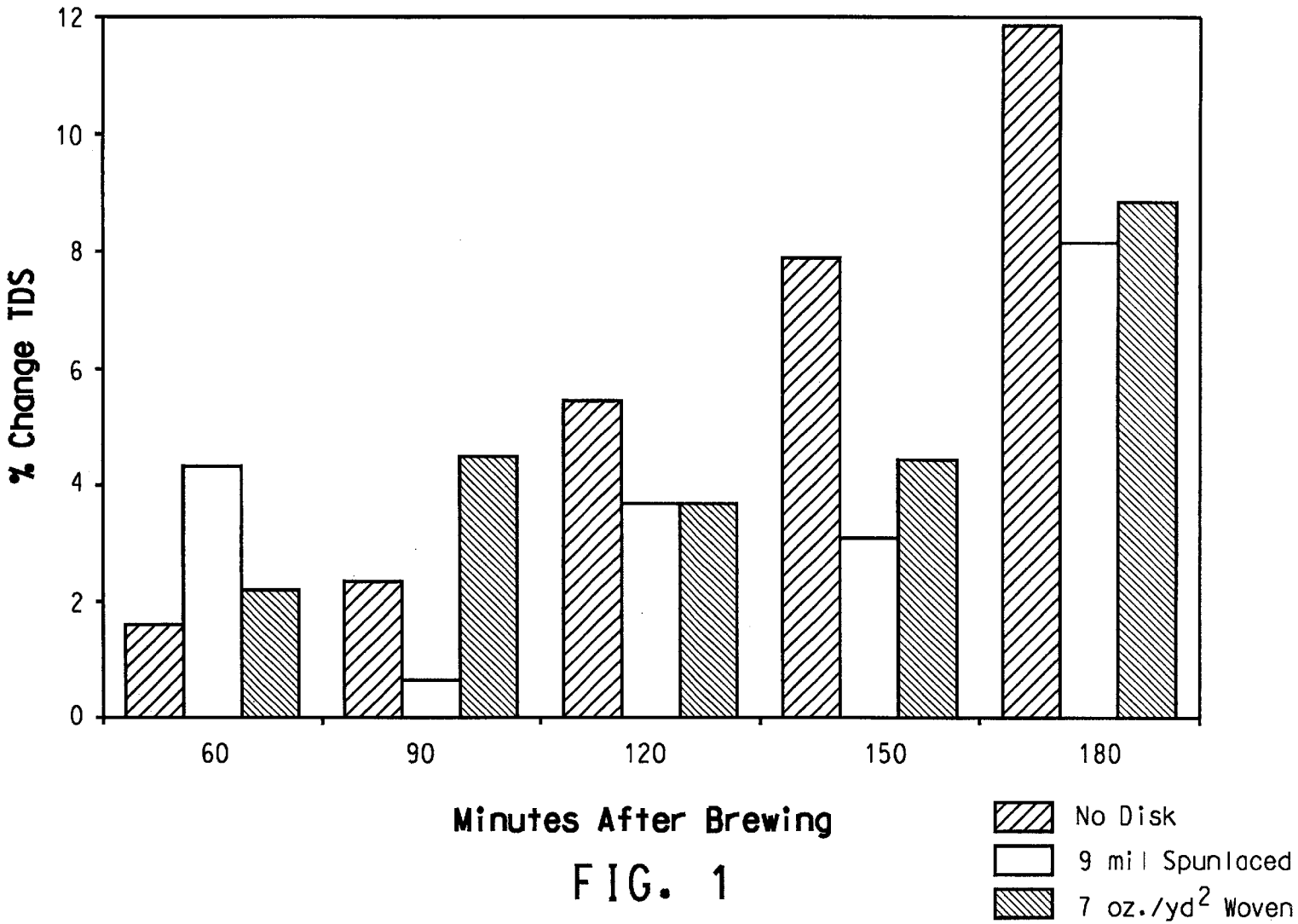
FIG. 1 shows a comparison of the total dissolved solids in coffee maintained at the holding temperature as a function of time for no disk, as a control, a 9 mil spun laced disk and a woven fabric disk both disks according to the present invention.

The present invention provides a fabric disk for protecting the flavor of a coffee or tea wherein the disk is placed between a container (carafe) in which the beverage is stored and a hot plate which supports the container and also keeps the coffee or tea at the desired holding temperature, the fabric disk comprising heat resistant fibers.

The disk may be formed as a non-woven or woven fabric.

As used herein, the term heat resistant fibers means fibers that do not melt, shrink or burn at temperatures of from about 40 to about 100° C. Such fibers may be in the form of cut fibers, staple yarns or filament or multifilament yarns.

The length and denier of fibers and yarns useful in the present invention is not critical although for thinner disks it is preferable to use fibers of low denier. Also it is preferable to make thin disks from non-woven fabrics for the ease of manufacture. Cut fiber lengths and deniers used in higher performance textile applications are suitable, but it is recommended that cut fibers be nominally 0.25 to 2 inches (about 0.64 to about 5 cm) in length, and filaments be about 1.5 denier (1.7 dtex). For a woven fabric recommended yarns are 2 ply, and the recommended weave is 16/2's cotton count (27/2 Nm). Various types of microdenier fibers resulting from melt-blown or spunbonded processes may also be used.

The use of fibers or yarns having a modulus in the range of from 150 g per denier or more in constructing the disk helps in maintaining the shape and flatness of the disk even at low fabric weight. To achieve both protection of the flavor of the hot coffee or tea and to maintain the holding temperature, it is essential that the disk be in thermal contact with both the bottom of the serving container and the heating surface in the brewing apparatus.

When the disk of the present invention is formed from a woven fabric, a fabric containing at least 5% by weight p-aramid fibers is preferred. The p-aramid fibers may be incorporated into the fabric in a blend of staple yarns, as individual staple yarns or as individual filament yarns. For example, in a rip-stop weave, p-aramid yarns or yarns containing higher concentrations of p-aramid fibers may be used as the rip-stop yarns.

In a woven disk of the present invention, it is desirable to stabilize the edges of the disk against raveling by adding a binder or by fusing the edges to provide a thin non raveling edge and allow the disk to contact the surfaces of the hot plate and the beverage container. A woven fabric disk may also be treated with a suitable adhesive that is stable at the holding temperature and temporary in nature. Temporary in nature means that the adhesive is not permanent so that disk can be removed once soiled. Also in the woven woven fabric disk of the present invention, placement of the p-aramid containing yarns in a geometry that provides contact across the face of the heating surface have proved to be of particular value. Useful woven fabric include plain, twill, satin, basket or rip-stop weaves.

The most preferred form of the present invention is a non-woven fabric disk having a density of not more than 2 oz/yd$^2$ (34 g/m$^2$) and a total thickness of not more than 12 mils (305 microns). This non-woven disk provides optimum flavor protection at optimum holding temperature. That is, the temperature necessary to maintain the coffee at the desired sipping temperature (>170 F.). Fibers useful in construction of such a disk include p-aramid, m-aramid, polybenzimidazole, polybenoxazole, poly(phenylene sulfide), polybenzothiazole, polyimide and mixtures of these fibers. Minor amounts of other fibers may be added so long as these fibers do not appreciably effect the performance of the heat resistant fibers. Aramid fibers include those fibers containing at least 85% by weight aramid polymer. The p-aramid fibers may be in whole or in part formed from sulfonated p-aramid polymer units.

In any disk according to the present invention, the disk may be constructed as a background fabric where p-aramid yarns or yarns containing higher concentrations of p-aramid fibers may be attached to the background fabric as a grid. This grid may be attached on one or both sides of the background fabric. If it is to be attached on only one side of the background fabric, it is preferred that the grid side of the disk be used in contact with the heating surface of the brewing apparatus. Attachment of the grid may be by weaving-in for a woven background fabric, stitched on, or attached a layer in a layered construction. In the case of a non-woven background fabric, the grid may be attached by stitching, as a web on which the non-woven fabric is formed, or as layer in a layered construction. There may be other suitable means by which the grid can be placed on the background fabric known to those of skill in this art.

The disk of the present invention eliminates development of hot spots or zones of higher temperature in the liquid and produces a more uniform, even heating of the liquid. The shape of the disk is preferred to be that of a circle or a polygon. For a polygon shape one having 5 or more sides is preferred.

The present invention also provides an improved brewing apparatus for brewing coffee or tea, the apparatus having a hot plate and a movable beverage container the bottom of which is in contact with the hot plate, a fabric disk comprising heat resistant fibers wherein the disk has a thickness of less than about 12 mils and a density of less than about 2 oz/yd$^2$ (34 g/m$^2$) and wherein the disk is sized to cover the hot plate and is positioned between the container bottom and the hot plate. By cover the hot plate, it is meant the disk has a size large enough so that the bottom of the container does not touch the hot plate directly. It has been found that disks which are slightly larger than the hot plate, from around ⅛" to 1" (3 to 25 mm) larger, give the best performance. It is thought these oversized disks help to eliminate cooling convective drafts that can remove heat from the warming plate.

For best performance it is preferred that the disk is formed from a non-woven fabric. The disk may be formed from spun laced fabrics, spun bonded fabrics, melt blown fabrics or woven fabrics. Preferred heat resistant fibers include m-aramid or a mixture of m-aramid and p-aramid fibers. The disk is preferably has a patterned or embossed surface which can be created in the manufacture of the non-woven sheet as disclosed in U.S. Pat. No. 3,485,706 or by calendering the sheet. This disk may be treated for stain and water repellency and may also be treated with a non-slip treatment to increase friction between the warming plate and the disk.

The disk of the present invention may be treated for stain and water repellency and may also be treated with a non-slip treatment to increase friction. Such non-slip treatment is preferred to be a thin, discontinuous coating of a silicon resin on at least one side of the disk. The preferred method of applying such a coating is by a printing process.

The present invention also provides a method of brewing coffee or tea wherein heated water is passed through grounds of coffee or leaves of tea into a container supported on a hot surface designed to maintain the coffee or tea at a temperature above room temperature, method comprising placing between the container and the hot surface a fabric disk comprising heat resistant fibers wherein the disk has a thickness of less than about 12 mils and a density of less than about 2 oz/yd$^2$ (34 g/m$^2$).

The general technique used to brew coffee, is the drip method in which heated water of a temperature more than 180 to 205° F. is passed through a bed of ground, roasted coffee beans to extract the coffee oils. For optimum flavor the coffee once brewed must be held at in a temperature range of 170 to 180° F. The preferred temperature for drinking coffee (the sipping temperature range) is about 140–170° F. with the most popular sipping temperature being 160° F.

In order to produce an economical drip coffee maker, many manufacturers use the same heating element to both bring the water to brewing temperature and to heat the hot plate to maintain the coffee at holding temperature. The use of one heating element often times means that the coffee holding temperature must be set at a temperature higher than the optimum holding temperature. That is a temperature high enough to cause coffee flavor degradation over a short period of time. Also the nature of the on-off heating element and design of the drip coffee makers lead to the formation of hot spots on the hot plate surface and in the coffee liquid. Such hot spots over time cause the loss of aromatic oils and the formation of bitter tasting components in the coffee. The deterioration of coffee flavor is associated with an increase in the total dissolved solids in the coffee. FIG. 1 shows the percent increase in dissolved solids for coffee from 60 to 180 minutes after brewing. When the disk of the present invention is placed between the carafe and the hot plate, lower concentrations of dissolved solids result indicating that the flavor is protected. The coffee is also maintained at a desired holding temperature (>170° F.).

Figure 2A:
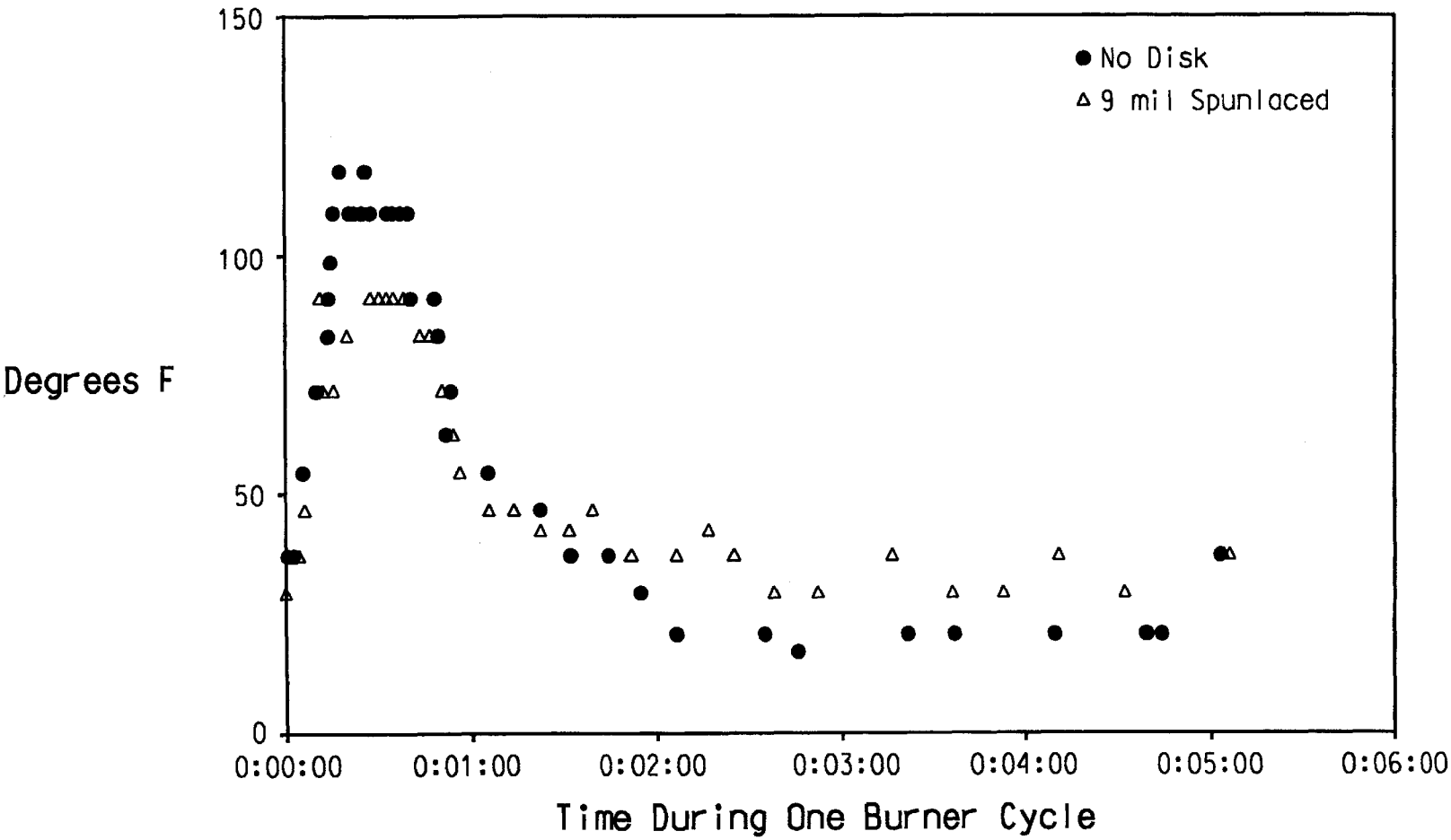
FIG. 2*a* shows the difference in the hottest part of a drip coffee maker heating cycle when no disk is used and when a 9 mil spun laced disk of the present invention is used. The variation in the liquid coffee temperature over time with the 9 mil spun laced disk of the present invention is shown in FIG. 2*b* and without the disk in FIG. 2*c*.
Figure 2B:
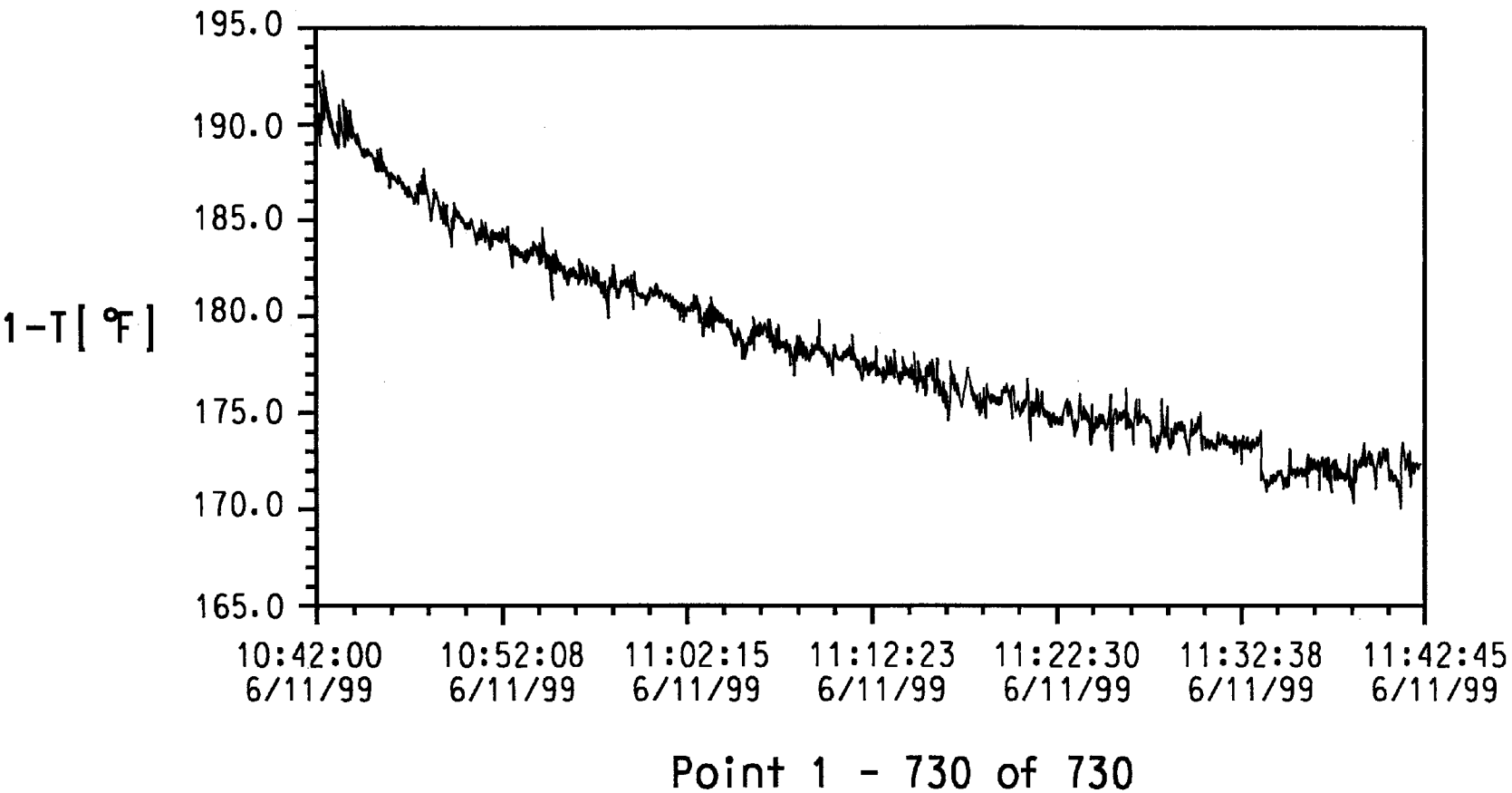
Figure 2C:
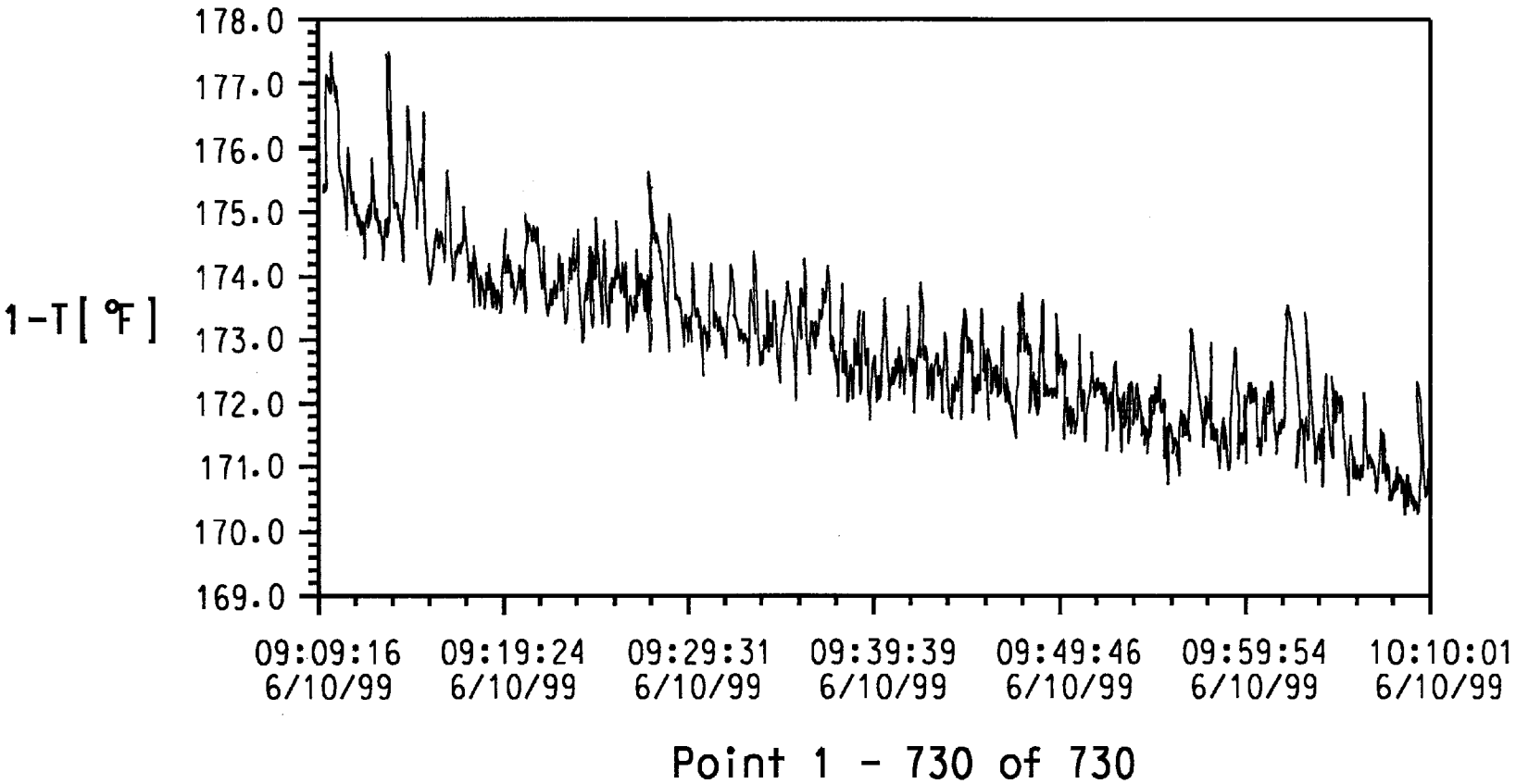

FIGS. 2*a*, 2*b*, 2*c* and Example 3 show the variations in temperature of the heating plate and the coffee with and without the use of the disk of the present invention. These charts illustrate the uniformity in temperature in the coffee liquid and the moderation of both hot spots and loss of heat at the hot plate surface achieved by the present invention.

The present invention provides a thin, non-woven disk which, placed between the coffee container and the hot plate, evens out the coffee holding temperature while not appreciably reducing the holding temperature below 170° F. The disk aids in maintaining the coffee at optimum holding temperature while at the same time delays and reduces the formation of bitter favor bodies and the loss of aromatics. The disk provides this optimum distribution of temperature without causing loss of heat so as to reduce the coffee temperature below the optimum holding temperature. The form of the present invention providing the greatest level of performance is a non-woven disk having a thickness of less than about 12 mils and a density of less than about 2 oz/yd$^2$ (34 g/m$^2$). Total thickness means that the sum of the thickness of the non-woven fabric and any surface treatment such as a non-slip, discontinuous friction coating or a combination of a non-slip and stain or water repellency coating is less than 12 mils. It is generally preferred that this non-woven fabric thickness be about 1 to 10 mils and the treatment layer be from 2 to 5 mils.

The following example illustrates the present invention, but are not intended to limit the invention.

EXAMPLES

Example 1

The following example illustrates a woven disk of the present invention. The evaluation of flavor in the following tests was subjective and bases on the coffee consumer's sensation and taste during and after the time the coffee was tasted. The color of the coffee as a function of time kept at temperature was a visual comparison of the color of the coffee at the time to the color of the coffee when initially brewed.

Coffee was prepared in a MR.COFFEE brand home coffee maker. The coffee used was a typical regular grind coffee available at grocery stores or super markets.

After brewing the coffee, it was tasted and then maintained at the holding temperature produced by the coffee maker hot plate. This temperature was determined by measuring the temperature of water processed by the coffee maker as a function of time. From this test it was determined that the temperature immediately after brewing was 180° F.; the temperature of the water decreased at a rate of about 10° F. for each one half hour until the temperature reached a constant value of 147° F.

Table I provides a summary of fiber material tested and the time after brewing that each material provided flavor protection. Without the disk, the flavor began to deteriorate after less than one hour after brewing.

The weights are fabric weights in oz/yd$^2$. The fabrics are all woven fabrics. Fabric 1 is a m-aramid fabric containing 5% by weight p-aramid fiber; fabric 2 and 3 are a woven fabric of 100% polybenzimidazole, each at a different weight; fabric 4 is 100% m-aramid fabric; fabric 5 is a knitted m-aramid fabric; and fabric 6 is a rip-stop weave of staple yarns made from an intimate blend of 60% by weight m-aramid fibers and 40% by weight p-aramid fibers. Fabric 6 is available from Southern Mills as NOMEX Advance brand fabric. (NOMEX is a trademark of the E.I. DuPont de Nemours Company of Wilmington, Del.).

The knitted fabric provided no protection of the flavor. The coffee flavor deteriorated as if no disk were present.

TABLE I

| Weight | Fabric | Taste | Time | Color |
|---|---|---|---|---|
| 7.5 oz | 1 | Bitter | 4 hrs | Dark |
| 7.5 | 2 | Bitter | 3 hrs | Dark |
| 6.5 | 3 | Bad | 3 hrs | Dark Black |
| 9.5 | 4 | Bad | 2.5 hrs | Dark |
| 6.0 | 5 | Bad | 3.5 hrs | Black |
| 7.5 | 60/40 | Good | 5 hrs | Dark |

TABLE II shows the evaluation of the coffee flavor and color at the time noted after brewing, but in this case the disks were tested for a series of days to determine if there were any loss in flavor protection as a function of cycles in heating and cooling of the disk. In this test, the days used are the number of cycles and the hours are hours after brewing. The hours reported are the hour after brewing at which the observation was made on the last cycle day. For example, after 3 total cycle days and after 3 hours of remaining at holding temperature on the third day, the coffee protected by fabric disk 1 had acceptable flavor and good color. Fabric 7 was a 100% m-aramid fabric in a waffle weave.

TABLE II

| Days Used | Total | Fabric | Weight | Taste | Color |
|---|---|---|---|---|---|
| 3 | 3 | 1 | 8.5 oz. | OK | Good |
| 5 | 6 | 4 | 9.5 | Bitter | Good |
| 2 | 6 | 7 | 8.0 | Bitter | Dark |
| 25 | 8 | 6 | 7.5 | Good | Good |

Comparing Tables I and II show that the woven fabric having the best performance in flavor protection for both the extent of time the coffee can be maintained at temperature and the number of cycles was fabric 6. Table III shows the coffee temperature that was maintained with the use of fabric 6. The temperature maintained when fabric 6 is used is surprisingly similar to that maintained when no disk was used.

TABLE III

| Fabric 6 with Coffee | | | | |
|---|---|---|---|---|
| Time | Temp. | Taste | Color | Weight |
| 8:15 | 180 | Good | Light | 7.5 oz |
| 9:15 | 150 | Good | Light | 7.5 |
| 9:45 | 145 | Good | Light | 7.5 |
| 10:00 | 149 | Good | Light | 7.5 |
| 10:15 | 148 | Good | ½ & ½ | 7.5 |
| 11:00 | 147 | Good | ¼ & ¾ | 7.5 |
| 12:30 | 147 | Good | ¼ & ¾ | 7.5 |
| 1:00 | 147 | OK | Dark | 7.5 |

Table III illustrates the flavor protection provided by disk 6. After almost 4 hours of maintaining the coffee at the holding temperature, the flavor of the coffee was still as good as the initial brew although the color of the coffee had darkened.

Example 2

The total dissolved solids in coffee as a function of the minutes after brewing was measured using a woven and a non-woven fabric disk. The results are shown in FIG. 1. To determine the total dissolved solids, conductivity of a sample of coffee was measured using standard analytical practices.

The disk of the present invention was made form a NOMEX brand non-woven fabric trademarked E89 and was 1.8 oz/yd$^2$. This fabric was calendered and has a 13 mesh pattern. It was 9 mil in thickness. This non-woven fabric is 70% by weight m-aramid and 30% by weight p-aramid fiber.

Example 3

A drip coffeemaker hot plate typically operates by a thermostat located on the hot plate heating unit itself. This thermostat turns the heating element on and off approximately every 3 to 6 minutes in order to maintain coffee at the holding temperature. The typical on time for the heating element is about 1 minute. During this on time the heating unit can exceed a temperature of 200° C. Since the hot plate surface is in direct contact with the heating element, high temperatures of the element result in a hot spot on the hot plate. These hot spots result in higher temperatures in the coffee liquid that degrade the coffee flavor. FIG. 2*a* shows the temperature affects of the heating cycle on the hot plate temperature as measured by infrared videograph. FIG. 2*b* and 2*c* show the affect of the heating cycle on the temperature of the liquid coffee measured at the bottom and the top of the coffee carafe. The disk used in the test data presented in these figures was a disk made according to Example 2. For comparison and as a control, data was measured with no disk in place over the hot plate surface. Data for the performance of the present invention was measured using the disk of Example 2.

Looking at FIG. 2*a*, one sees that the significant impact of the disk of the present invention is to reduce the high temperature spike when the heating element turns on. In the Figure the difference in the temperature with the disk and with no disk is 40° F. This temperature difference drops to 15° F. when the heating element in off.

FIGS. 2*b* and 2*c* show how the spiking of the temperature influences the temperature of the liquid coffee measured in the carafe. The FIG. 2*b* shows that the disk of the present invention dampens the very hot temperature spikes but at the same time moderates the heat flow across the pad to provide a uniform holding temperature. FIG. 2*c* shows the variations in the liquid coffee temperature when no disk is present and the carafe is in direct contact with the hot plate.

Example 4

This example illustrates consumer approval for coffee flavor protected by the disk according to the present invention. The disk used in this test was prepared according to Example 2 except that a non-slip discontinuous silicon coating was applied to the face of the disk that was in direct contact with the hot plate.

A sheet of the NOMEX brand fabric trademarked E89 (available form E.I. DuPont of Wilmington, Del.) was masked by a metal sheet having holes of 0.09 inches in diameter and spaced 0.25 inches apart in a diamond grid pattern. The metal mask was placed over the fabric and liquid polydimethylsiloxane resin was spread over the surface of the mask. The mask was removed leaving the dot pattern of resin on the fabric. This coated fabric was cured for 2 minutes sec at 350° F. so that the siloxane resin became hard. The fabric was then cut in a circular shape to make the disk.

This disk was placed on the hot plate of a drip coffee maker between the hot plate and the carafe to make test coffee. Control coffee was made without using the disk of the present invention but using the same ground coffee, same type coffee maker so that the brewed coffees would be equivalent except for the use of the disk in the test coffee. The test and the control coffees were held at the coffee maker holding temperature for 30, 60 and 120 minutes. At each of the holding times the flavor of the coffee was rated by consumers. The flavor test was done by a professional coffee testing service using standard statistical coffee tasting methods. At each of the holding times, consumers selected the test coffee at approximately 9 to 1 over the control coffee as having the preferred flavor.

What is claimed is:

1. A fabric disk for protecting the flavor of coffee or tea wherein the disk is placed between a container in which the beverage is stored and a hot plate which supports the container and also keeps the beverage hot, the fabric disk comprising heat resistant fibers wherein the heat resistant fiber contains at least 5% by weight p-aramid fibers.

2. The fabric disk of claim 1 where in the heat resistant fibers are 60% by weight m-aramid fibers and 40% by weight p-aramid fibers.

3. The fabric disk of claim 1 or 2 wherein the disk has a thickness of less than about 12 mils and a density of less than about 2 oz/yd$^2$ (34 g/m$^2$).

4. The fabric disk of claim 1 wherein the m-aramid and p-aramid fibers form yarns and the yarns are woven in a rip-stop weave.

5. The fabric disk of claim 1 wherein p-aramid yarns or yarns containing at least 30% by weight p-aramid fibers form a grid attached to a background fabric.

6. The fabric disk of claim 1 wherein the edge of the fabric disk is stabilized from raveling by the addition of a binder or by fusing.

7. The fabric disk of claim 1 wherein the disk is treated with a pressure sensitive adhesive.

8. The disk of claim 1 in having a generally round symmetrical shape.

9. The disk of claim 1 wherein the shape of the disk is that of a circle or a polygon.

10. A brewing apparatus for brewing coffee or tea, the apparatus having a hot plate and a movable beverage container the bottom of which is in contact with the hot plate, a fabric disk comprising heat resistant fibers wherein the disk has a thickness of less than about 12 mils and a density of less than about 2 oz/yd$^2$ (34 g/m$^2$) and wherein the disk is sized to cover the hot plate and is positioned between the container bottom and the hot plate.

11. The fabric disk of claims 1 or 6 wherein the disk is treated with a water repellent or stain repellent coating.

12. The fabric disk of claims 2 or 10 as wherein the disk is formed from a non-woven fabric.

13. A fabric disk for protecting the flavor of coffee or tea wherein the disk is placed between a container in which the beverage is stored and a hot plate which supports the container and also keeps the beverage hot, the fabric disk comprising heat resistant fibers wherein the disk has a thickness of less than about 12 mils and a density of less than about 2 oz/yd$^2$ (34 g/m$^2$).

14. The disk of claims 1 or 11 wherein the disk is from about ⅛ to 1 inch (3 to 25 mm) larger than the hot plate.

15. The disk of claim 13 wherein the disk is selected from the group consisting of spun laced fabrics, spun bonded fabrics, melt blown fabrics and woven fabrics.

16. The disk of claim 13 or 12 wherein the heat resistant fibers are m-aramid or a mixture of m-aramid and p-aramid fibers.

17. The disk of claim 15 wherein the heat resistant fiber contains at least 5% by weight p-aramid fibers.

18. The disk of claim 15 wherein the heat resistant fibers contain at least 30% by weight p-aramid fibers.

19. The disk of claim 13 wherein at least one surface of the disk is treated to increase friction between the disk and the hot plate.

20. The disk of claim 19 wherein the treatment is a thin, discontinuous coating of silicon material.

21. The disk of claim 20 wherein the silicon material is applied to the disk by a printing process.

22. The disk of claim 20 wherein the silicon material is applied to the disk by a printing process.

23. A method of brewing coffee or tea wherein heated water is passed through grounds of coffee or leaves of tea into a container supported on a hot surface designed to maintain the coffee or tea at a temperature above room temperature, method comprising placing between the container and the hot surface a fabric disk comprising heat resistant fibers wherein the disk has a thickness of less than about 12 mils and a density of less than about 2 oz/yd$^2$ (34 g/m$^2$).

24. The method of claim 23 wherein the heat resistant fibers are a mixture of m-aramid and p-aramid fibers.

25. The method of claim 24 wherein at least one surface of the disk is treated to increase friction between the disk and the hot plate.

26. The method of claim 25 wherein the treatment is a thin, discontinuous coating of silicon material.

27. The method of claim 23 wherein the heat resistant fiber contains at least 5% by weight p-aramid fibers.

28. The method of claim 27 wherein the heat resistant fibers contain at least 30% by weight p-aramid fibers.

29. The method of claims 23 wherein the disk is from about ⅛ to 1 inch (3 to 25 mm) larger than the hot plate.

* * * * *